US005807196A

United States Patent [19]

Pompeo

[11] Patent Number: 5,807,196

[45] Date of Patent: Sep. 15, 1998

[54] TENNIS PRACTICE DEVICE

[76] Inventor: Maurizio Pompeo, Viale des Geneys 22, Genoa, Italy, I16121

[21] Appl. No.: 392,965

[22] PCT Filed: Oct. 4, 1993

[86] PCT No.: PCT/EP93/02707

§ 371 Date: Mar. 31, 1995

§ 102(e) Date: Mar. 31, 1995

[87] PCT Pub. No.: WO94/07577

PCT Pub. Date: Apr. 14, 1994

[30] Foreign Application Priority Data

Oct. 5, 1992 [IT] Italy ..... GE92A0104

[51] Int. Cl.[6] ..... A63B 67/00

[52] U.S. Cl. ..... 473/463; 473/573

[58] Field of Search ..... 273/DIG. 30, 29 A, 273/67 R, 346, 327, 186 E, 61 B; 473/424, 463

[56] References Cited

U.S. PATENT DOCUMENTS

| | | | |
|---|---|---|---|
| 3,820,785 | 6/1974 | Occhipinti | 473/463 |
| 4,789,161 | 12/1988 | Waskelo | 273/327 |
| 4,826,173 | 5/1989 | Brown | 273/186 E |
| 4,834,396 | 5/1989 | Feldi | 273/61 B |
| 5,005,834 | 4/1991 | Ferrari | 473/524 |
| 5,080,374 | 1/1992 | Yu | 273/346 |
| 5,261,673 | 11/1993 | Miller | 273/346 |
| 5,324,029 | 6/1994 | Kim | 273/67 R |

OTHER PUBLICATIONS

Playthings Feb. 1977.

*Primary Examiner*—Theatrice Brown
*Attorney, Agent, or Firm*—Bucknam and Archer

[57] ABSTRACT

A tennis practice device comprises a housing made of two oval elements. The two elements are made of a material which permits to stop the ball at the moment of the impact because the material when it is coupled with the material which covers the ball causes the ball to adhere strongly to the tennis racket. The device may be used indoors and a teacher may train several students at the same time to determine the point of impact of the ball.

4 Claims, 2 Drawing Sheets

TENNIS PRACTICE DEVICE

The present invention relates to a housing for a tennis racket having two elements to stop the ball which constitutes a simulator of the tennis game mainly for teaching purposes.

It is well known that in the teaching of the tennis game several drawbacks have been encountered. According to a known method, it is necessary to have available a great deal of space because the student must learn to hit the ball with the racket with force without causing injury to people or damage to property. Frequently, the tennis courts are located outdoors so that the possibility of carrying out the instructions depends also on the atmospheric conditions.

According to the known method, in view of the fact that the teacher frequently has several students and must examine the game of each student individually, in order to verify the point of impact of the ball, substantial loss of time is unavoidable in order to collect the balls from the container basket, make sure that the other students have completed their game, collect the balls from the field after the balls have been thrown and put the balls back in the basket. According to this known method, the student, particularly if he is very young, may become bored by the first phase of teaching also because of the long period of idle time and may lose interest in the tennis game.

According to the known method, the student who wishes to train by himself in addition to better understand the teachings which he has received, must face the inconvenience involved in the space requirement mentioned hereinabove, unless he is satisfied with exercising without the ball, by being limited to repeating the motion without the main impact of the ball on the racket.

The use of Velcro or similar material, in articles of play is disclosed in previous patents, yet none of them has the features required to solve the problems which this invention solves to attain its objective, namely to offer a tennis game simulator which can also be used at home. Therefore no other previously known method can offer the below mentioned advantages, which can be obtained with this invention. By "Velcro" is intended a material which comprises hook and loop component forming fastening means.

Patent EP-A-0 488 562 discloses a racket with one hitting surface which is only partially covered with a coating of Velcro material. The very feature of this patent is in the fact that in this equipment the operative surface includes a first (uncoated) region adapted to permit the projective to rebound therefrom, that portion which should properly be used to strike the projectile, namely the very part which has to hit the projectile, and a second region (coated with Velcro) adapted to remain the projectile thereto, the use of which is undesirable. The game with this equipment involves the hitting of the projectile with the central part which has no coating to throw the ball far away.

The primary objective of the invention disclosed in the U.S. Pat. No. 5,080,374 patent is to provide an article of play which can be used in the game of both hit and catch, and for this purpose the board portion of the racket has only one side covered with Velcro material, which is fixed by sewing operations on a flexible layer, that is engaged on the racket in a wall portion which is stably engaged by a frame. With both the above mentioned devices the ball is always expected to bounce and be thrown far away. Therefore, none of them can be employed in small spaces, for example at home, nor can it hold the ball on the racket, for educational purposes.

U.S. Pat. No. 4,149,726 patent specifically refers only to a training golf club which is provided with a pivotable arcuate rigid base portion of metal pivotably secured by screw on one side only of the head portion of the club. The Velcro material is tautly stretched across its cavity. It also provides for the use of "a ball" which is absolutely special, since it has an elongate cylindrical shape.

SUMMARY OF THE INVENTION

The object of the present invention is to provide a device which permits to solve the drawbacks mentioned hereinabove in a simple and economic manner.

For this purpose, a velcro housing or of similar other material is provided which always covers practically both faces of the tennis racket and which allows to stop the ball at the moment of impact.

Materials are known, such as the material of the type known under the brand name of velcro which when they are put together in a complementary manner, adhere strongly between themselves but which are always and repeatedly separable if they are subjected to a traction force. For instance, there are known couplings of materials with a hook and an eye, materials which are plastified in the shape of a mushroom with a material having a pile or jersey, materials with a spike with velvet or similar material which for simplicity will be referred to hereinbelow as male and female type.

According to one embodiment of the present invention, the tennis rackets are covered on both faces of the strings with the material of the male type while the balls which are of dimensions equal to the dimensions used in the tennis game are covered by a material of female type. Conversely, one may use the material of the female type on the tennis racket and the material of male type on the ball.

In view of the fact that in the teaching of the tennis game, it is fundamental to correctly throw the ball on the tennis racket with the housing according to the present invention, due to the coupling of the complementary materials, at the moment of the impact of the ball on the racket, the ball is stopped on the racket in the acquired position adhering immediately to the racket and therefore permitting to achieve substantial advantages in the teaching of the game, a fact which could also influence the number of people and the quality of individuals who love the game and who dedicate themselves to this sport, also permitting future improvement from the point of view of contests in which the individuals may be come involved. The housing according to the present invention when it is inserted on top of a tennis racket constitutes an optimum simulator of the tennis game and by means of the device according to the present invention, it is not necessary to have available substantial space in order to permit to follow the ball after the impact, because at the moment when the student throws the ball with force, the ball remains adhering to the racket and remains stopped in the same position. In view of the fact that the possibility of causing injury to individuals or damages to properties is eliminated, the lesson may be carried out also with several students in a small gymnasium and even under unfavorable atmospheric conditions in a manner analogous in general with the simulators which exist with other sports such as cycling, boating, windsurfing, golf etc.

With the device according to the present invention, the teacher may train different students also simultaneously, particularly for the first basic exercises of the tennis game which consists of learning the correct position of waiting, service, impact and final because the ball may be used immediately again without the conventional waste of time involved in collecting the balls from the container basket, waiting until the other students have completed their game, collecting the balls in the field after they have been thrown and placing the balls again in the basket. The teacher, therefore, may easily verify with each student the point of impact of the ball on the face of the strings, in order to correct the game of each student. The present invention permits to save about 4/5 of the time which is conventionally required for exercises by the known methods so that one achieves the advantage of greater interest on the part of the students and a more effective utilization of the time of the lessons. In addition, there is no risk that the students will be hit by the balls of other students so that the students may practice throwing the balls even when they are arranged in two lines, one in front of the other simultaneously.

As a result of the present invention, the teacher may advantageously let the students practice also when they are in motion because the teacher may throw the balls to the students with his conventional tennis racket which has no housing as in normal teaching. The students with the tennis rackets provided with the housing according to the present invention will run as usual in order to receive the ball which will remain held on the tennis racket which has the housing.

With the device according to the present invention, the possibility of finding easily the point of impact of the ball on the face of the strings is very advantageous. The teacher may unquestionably control with each student the point of impact of the ball in order to correct the distance of the ball at the moment of the impact because the impact must occur during the return phase in the center of the racket and if the ball remains on top or the heart of the racket, this indicates a distance which is either too great or too small.

With the housing according to the present invention, if one has been careful enough to distinguish, for instance, by means of color, the two faces of the housing of the racket, the teacher may control even with several students, simultaneously and with high frequency of the throwing of the balls, the impact called 'volley' on the forehand or on the backhand and verify also the face of the strings with which the student has returned the serve.

With the housing according to the present invention, the student is able to practice in any location, and especially at home, acquiring training in addition to the single repetition of the throwing motion, also in the impact with the ball without the risk of causing damage to surrounding objects and, therefore, take much better advantage of the teachings which he has received and, therefore, effectively reduce the period of time required for teaching the correct throwing of the ball.

With the housing according to the present invention it is not necessary to have a great number of balls, but it will be sufficient to have a single ball for each student because the ball remains adhering to the racket and can be separated easily and used again.

With the housing according to the present invention, the student will enjoy much more also the first phase of teaching for two reasons, because it will be possible to avoid the long periods of idle time and also because on the housing, it is possible to trace some areas with some markings according to the point of impact, a fact which will constitute an inducement to compete with other students during the lesson or when he plays in the real game in exercises outside of the field, for instance to learn the correct throwing of the ball during the serve phase, which is fundamental.

The ease of placing or removing the housing according to the present invention permits the teacher to continue the lesson with the conventional method after he has begun the lesson with the racket which has been covered according to the present invention.

According to one embodiment of the housing for the tennis racket with two elements stopping the ball, the two elements are disposed on each of the two faces of the tennis racket, they are oval in shape and the two elements are sewn together for assembly purposes, the sewing being carried out along the perimeter of the frame of the racket corresponding to the strings.

According to another embodiment of the invention, the two oval elements are connected between themselves along the perimeter of the frame of the racket corresponding to the strings by means of an elastic band which is transversely extendable or by means of a plurality of elastic support members which permits the adaptation of the housing to the rackets which may have a variety of dimensions. When the housing which is inserted on top of the frame which comprises the strings and extends itself up to the heart of the racket, is provided with the elastic band for the purpose of easily removing the racket, there is provided a suitable system of lateral closure, for instance, a zipper, hinge or similar device, in order to make it easily disassembleable.

According to a preferred embodiment, the housing is provided with a plurality of supports, for the purpose of adjusting to any racket size and of being easily removed, said supports may consist of radial openable elements consisting for instance of velcro or similar material or of elastic supports.

The two oval elements which are kept elastically stretched by said supports remain spaced with respect to the face of the strings by a distance of a few millimeters and this fact coupled with the elasticity of the elastic supports permits to deaden the impact of the ball thus favouring the blocking of the ball on the housing.

The oval elements of the housing may be suitably made with orifices which increase the aerodynamics and decrease the weight.

The housing may be made of a fabric material or a material which is not a fabric, optionally plastified, with an external surface of the male type (a hook, mushroom shape, spike or similar shape) with a ball of the female type or on the contrary, that is with the female type such as an eye, material of the velvet type, jersey, with a ball of the male type.

According to a further preferred embodiment of the invention, the elastic band is omitted and the two elements which stop the ball are being applied only on the face of the strings.

The two elements preferably of oval shape and of same dimensions are disposed directly on the two opposite faces of the strings adhering between themselves. The two elements are of size lower than the size of the frame of the racket so as to leave a border for the purpose of increasing the aerodynamics during motion. In analogy with the other embodiments, the external surfaces are of the male or female type depending on the type of the complementary material of the ball.

In order to ensure adherence between the two elements, the internal surfaces are made respectively as a male and female. Further or in the alternative, it is possible to use different means for holding the two parts together such as snaps or similar devices.

Between the external and the internal surfaces of the two oval elements or in the interior of the housing, there is advantageously provides also the insertion of a soft material such as, for instance a sheet of foam rubber of a similar article for the purpose of mitigating the impact with the ball and improving adherence.

The balls are of dimensions equal to the conventional tennis balls but they will have lower weight and lower rigidity. They must be covered by a material complementary with the material of the housing of the tennis racket and of female type respectively, for instance an eye, velvet type material, jersey, velvet or similar article or on the contrary of the male type such as a hook, mushroom shape, spike or similar articles in order to achieve the desired adherence.

BRIEF DESCRIPTION OF THE DRAWINGS

The advantages discussed hereinabove and others will appear clear from the description of the figures which are attached by way of illustration rather than limitation in which:

Similar elements in the several figures are designated by the same numerals. FIG. 1 illustrates the housing 18 of essentially oval shape which covers the frame 13 of tennis racket 10 up to the center which comprises the strings. The housing 18 is provided with a hinge 19 of the zipper type. The assembly seam 50 of the two opposite faces of the housing 18 along the perimeter of the tennis racket 10 is carried out by means of an elastic band 21 which is transversely extendable. FIGS. 5 and 6 show the housing 18 consisting of the two oval elements 11 and 12 of size smaller than of the frame 13 of the tennis racket which comprises the strings, connected between themselves by a plurality of elastic supports 25, the latter being extendable along the direction shown by the arrows in FIG. 6. The elastic supports 25 can maintain the two oval elements 11 and 12 well stretched, but elastically flexible so that as a result of the thickness of the frame as shown in FIG. 6, the internal surfaces of the oval elements 11 and 12 remain spaced from the face having the strings of a few millimeters so that the impact of the ball 40 and the blocking on the housing are deadened. On the oval elements 11 and 12 of the housing there are formed a number of orifices 22 in order to increase the aero-dynamics and decrease the weight, these orifices being sufficiently small to allow for adhesion of the ball on the housing. As seen in FIG. 6, the surface 42 of ball 40 and the external surfaces 15 and 23 of oval elements 11 and 12 are covered with complementary hook and loop fastening means in order to permit adhesion of ball 40 on oval elements 11 and 12.

For the purpose of removing easily a tennis racket from the housing 18, some of the elastic supports 25 may be substituted by openable members 24 which consist, for instance of velcro or similar material which may be of dimensions and external appearance similar to the elastic supports and which may keep in tension the oval elements 11 and 12.

Figure 1:
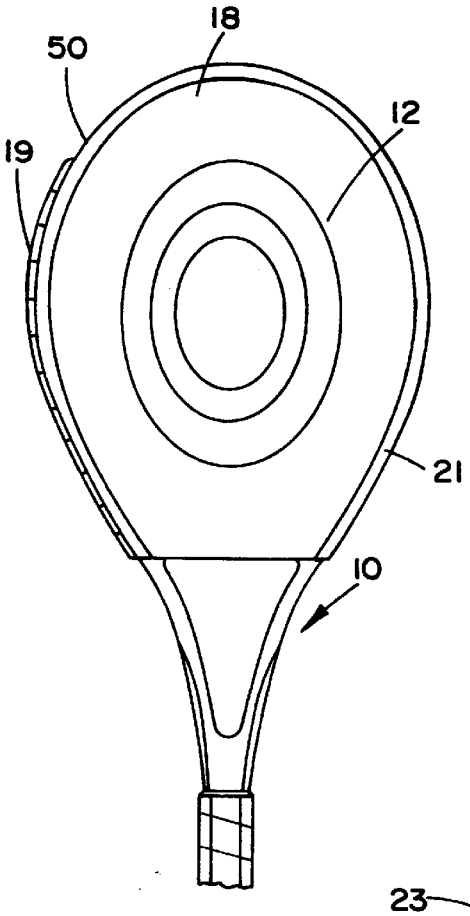
FIG. 1 is a view of a tennis racket covered according to the present invention, with a removable housing.
Figure 2:
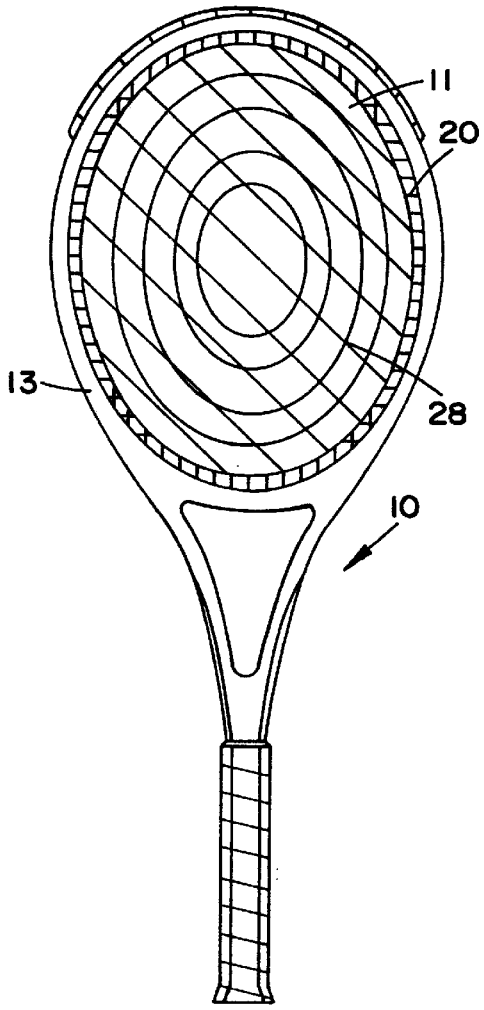
FIG. 2 is an elevational view of a tennis racket according to the present invention, with the strings covered by an oval element.
Figure 4:
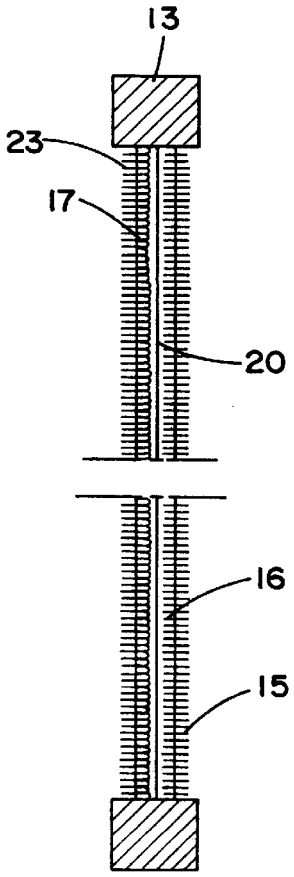
FIG. 4 is a transversal cross-section corresponding to the strings which has been enlarged to illustrate the coupling of the two oval elements according to FIGS. 2 and 3.
Figure 3:
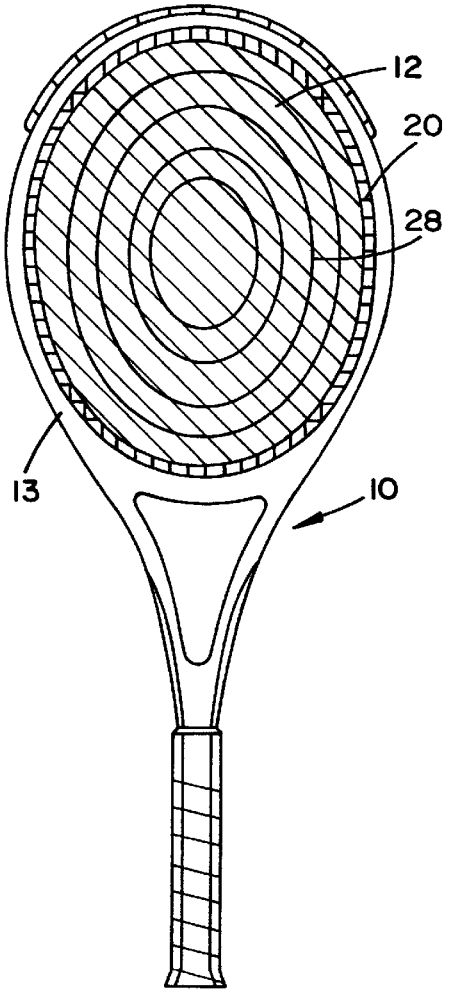
FIG. 3 is an elevational view of the face opposite to the face of FIG. 2, with the face covered by another oval element according to the present invention.
Figure 5:
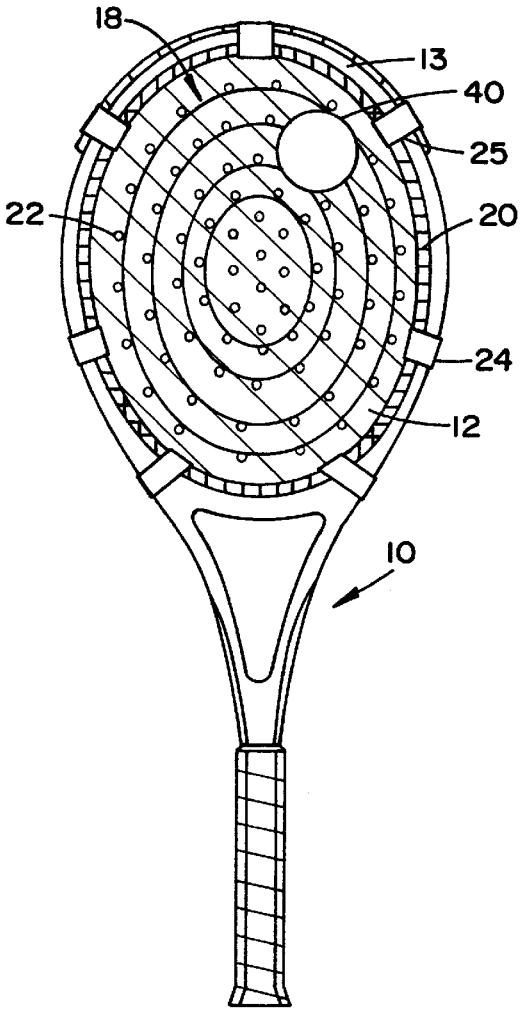
FIG. 5 is a view of a racket covered according to the present invention with a removable housing with a ball adhered thereto and the oval elements held by elastic supports.
Figure 6:
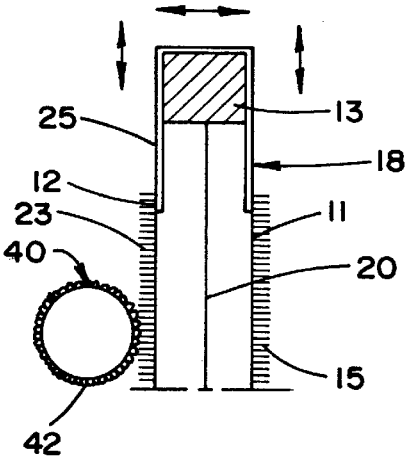
FIG. 6 is a transversal cross-section of FIG. 5 which has been enlarged corresponding to the frame to illustrate the coupling of the two oval elements.

FIGS. 2, 3 and 4 show the two oval elements 11 and 12, which have equal dimensions but which are distinguished one from the other because the external surfaces have different colors which are designated in FIGS. 2 and 3 with different types of markings. They are intended to be placed on the two faces of the strings 20 adhering between themselves. They are made of a size smaller than the size of the frame 13.

The external surfaces of the oval elements are divided in areas so that it is possible to use different types of markings by means of the parallel oval lined 28. In the embodiment shown in FIG. 4, the external surfaces 15 and 23 are shown as being of the male type. The internal surfaces 16 and 17 are of the male and female type respectively placed in front of the strings 20. The assembly of the two oval elements according to this embodiment is carried out simply by placing the two elements on the two faces of the strings 20 and fixing them with a slight pressure. The removal of the housing is easily carried out by taking them apart with some force.

For the production of the housing according to the present invention, there may be used a material which is heavier and which exhibits greater adhering power compared with the ball at the moment of the impact or if the ball is intended to be used by children, there may be used a material which is lighter than the ball even if the adherence of the ball at the moment of the impact is less strong.

The present invention comprises all the modifications of details and modifications which may appear to be obvious to one skilled in the art as long as they fall within the scope of the present invention, but it is understood that they fall within the scope of the attached claims.

I claim:

1. A tennis practice device which comprises a tennis racket having a frame of essentially oval shaped perimeter with two faces and strings; a ball; two essentially oval elements forming a housing covering the two faces and strings of said tennis racket and having external surfaces, said external surfaces of said two oval elements and and said ball being covered with complementary hook and loop fastening means, so that said ball upon impact removably adheres to said oval elements, said two oval elements being of equal size and slightly smaller than the size of said frame; elastic means for attaching said two oval elements along said perimeter of said frame to form said housing and holding said two oval elements under tension whereby said two oval elements are spaced from said strings by a few millimeters so as to deaden an impact of said ball.

2. The device according to claim 1 wherein said means for attaching said two elements along said perimeter of said frame are openable 24.

3. The device according to claim 2 wherein said means for attaching said two elements along said perimeter of said frame is a plurality of elastic supports (25).

4. The device according to claim 2 wherein said means for attaching said two elements are hook and loop components.

* * * * *